252-99. AU 185 EX
2-24-76 XR 3,940,340

United States Patent [19]
Bücking et al.

[11] 3,940,340
[45] Feb. 24, 1976

[54] PERACYLATED POLYAMINES COMPATIBLE WITH OPTICAL BRIGHTENERS AS ACTIVATORS FOR INORGANIC PEROXO COMPOUNDS

[75] Inventors: Hans Walter Bücking; Peter Hess, both of Kelkheim, Taunus; Franz König, Frankfurt am Main; Wilfried Sahm, Kelkheim, Taunus; Gerhart Schneider, Schneidhain, Taunus, all of Germany

[73] Assignee: Hoechst Aktiengesellschaft, Frankfurt am Main, Germany

[22] Filed: Jan. 7, 1974

[21] Appl. No.: 431,044

[30] Foreign Application Priority Data

Jan. 12, 1973 Germany ..... 2301437

[52] U.S. Cl. ..... 252/102; 252/89 B; 252/97; 252/99; 252/524; 252/543

[51] Int. Cl.[2] ..... C11D 7/54

[58] Field of Search ..... 252/97, 99, 102, 89 O, 252/89 B, 524, 543

[56] References Cited

UNITED STATES PATENTS

| | | | |
|---|---|---|---|
| 3,583,924 | 6/1971 | Demangeon et al. | 252/99 X |
| 3,741,903 | 6/1973 | Evans | 252/99 X |
| 3,753,915 | 8/1973 | Demangeon | 252/99 X |
| 3,775,332 | 11/1973 | Heins et al. | 252/99 X |
| 3,775,348 | 11/1973 | Jakobi et al. | 252/99 X |

*Primary Examiner*—Mayer Weinblatt
*Attorney, Agent, or Firm*—Connolly and Hutz

[57] ABSTRACT

Peracylated aliphatic polyamines are useful as activators for inorganic peroxo compounds, i.e., they set free the available oxygen of the peroxo compounds in aqueous solutions at temperatures below 80°C and are thus useful as additives to detergents especially inasmuch as they are compatible with usual detergent brighteners.

16 Claims, No Drawings

PERACYLATED POLYAMINES COMPATIBLE WITH OPTICAL BRIGHTENERS AS ACTIVATORS FOR INORGANIC PEROXO COMPOUNDS

The present invention relates to peracylated polyamines compatible with optical brighteners which are useful as activators for inorganic peroxo compounds.

It is known that washing and bleaching liquors which contain hydrogen peroxide, either as free substance or bound in the form of perborate, percarbonate, persilicate, perphosphate, or perpyro- or perpolyphosphate, percarbamide or melaminperhydrate, have bleaching effects already when washing at moderate temperatures, for example, synthetic fibers unstable to boiling at 30° to 60°C, if activators are added to these liquors, however, if no activators are added, the active oxygen of the peroxo compounds is fully utilized only at a temperature ranging from 80° to 100°C and so it remains in the washing liquors without being activated, when washing synthetic fibers sensitive to heat. As suitable activators for inorganic peroxo compounds have already been described acyl amides, such as, for example, tetraacetylglycol uril, triacetyl cyanuric acid, benzoylimidazole and tri- and tetraacetylethylene diamine. For being used in practice, it is very important that these activators, besides their activating effect and stability upon storage, are also compatible with optical brighteners in detergents.

From German Offenlegungsschriften Nos. 1,953,519 and 1,961,775 washing and cleaning agents are known which contain as optical brighteners derivatives of the 4,4-bis-(triazinylamino)-stilbene-2,2'-disulfonic acid, diarylpyrazolines and aminocumarines and as activators for peroxo compounds tetraacetylethylene diamine, tetraacetylglycol uril or benzoylimidazole. However, it appeared that the repeated use of the detergent compositions on the basis of these optical brighteners, peroxo compounds and bleaching activators reduced the degree of whiteness of the textile fabric washed which is due to the incompatibility of the optical brighteners with the activators.

It was found, that peracylated polyamines of the general formula (I)

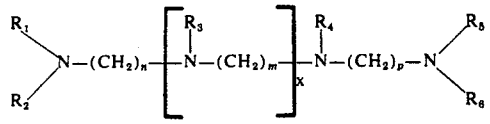

(I)

wherein $R_1$, $R_2$, $R_3$, $R_4$, $R_5$ and $R_6$ are identical or different acyl radicals having 2 to 8 carbon atoms, $x$ is 0, 1, 2 or 3 and $n$, $m$ and $p$ are 2 or 3, show an excellent compatibility with brighteners for detergents in addition to a very good bleach-activating effect and stability upon storage when combining them with inorganic peroxo compounds.

In the general formula I of the compounds to be used as activators in accordance with the invention, the acyl radicals $R_1$ to $R_6$ are, for example, aliphatic acyl radicals, such as acetyl, propionyl and butyryl radicals, moreover, the benzoyl or toluoyl radicals which may also be substituted by nitro groups, nitrile groups, methoxy groups or halogen atoms. The purely aliphatic acyl radicals containing two or three carbon atoms, and especially the acetyl radical, are preferred.

The compounds of the formula I may be prepared by reacting suitable polyamines, for example, diethylene triamine, triethylene tetramine, tetraethylene pentamine, dipropylene triamine or N, N'-bis-(β-aminoethyl)-1,3-propylene diamine or pentaethylene hexamine according to known methods with acetanhydride or propionic acid anhydride. The preparation of these compounds is described, for example, in U.S. Pat. No. 3,234,282. In an analogous manner, there may also be prepared the other acylated polyamines by reacting the polyamines with, for example, anhydrides, halides or esters of the corresponding carboxylic acids.

Optical brighteners suitable for detergents have been known for a long time (cf. Ullmanns Enzyklopadie der technischen Chemie, 3rd edition, vol. 11 (1960, page 695). There may be mentioned derivatives of the diaminostilbene-disulfonic acid, preferably the bis-(triazinyl-amino)-stilbene-disulfonic acid, especially such derivatives the triazinyl radicals of which are substituted by lower alkoxy groups, or radicals of primary or secondary amines, above all of the aniline series and low-molecular weight aliphatic amines. There may also be mentioned benzoxazoles, such as 1,2-bis-(benzoxazolyl-2')-ethylene, 2,5-bis-(benzoxazolyl-2')-thiophene, (Belgian Pat. No. 607,116), or 5,6-dimethyl-2-(p-carbalkoxystyryl)-benzoxazoles having lower alkoxy radicals, especially, methoxy and ethoxy groups (German Pat. No. 1,444,014); imidazole compounds, such as 1,2-bis-(imidazolyl-2')-ethylene; triazoles, such as 4-(naphtho-1,2; 4', 5'-triazolyl-2')-stilbene-2-sulfonic acid; pyrazolines, such as 1,3,5-triaryl pyrazolines, for example, 1-(4'-sulfophenyl)-3,5-diphenyl-Δ2-pyrazoline; butadienes-(1,3) substituted in 1,4-positions by aromatic radicals, such as 1-(α-naphthyl)-4-(β-naphthyl)-1,3-butadiene, 1-phenyl-4-(p-biphenyl)-1,3-butadiene, 1-phenyl-4-(α-naphthyl)-1,3-butadiene or 1-(benzoxazolyl-2')-4-(p-cyanophenyl)-1,3-butadiene, especially 1-(benzofuranyl-2')-4-aryl-butadienes, such as, for example, those obtainable by HORNER reaction from 2-(dialkylphosphono-methyl)-benzofuran and derivatives of the cinnamaldehyde.

As optical brighteners for detergents, there may especially be mentioned the compounds known from German Offenlegungsschrift No. 2,105,305, especially those which correspond to the general formula (II)

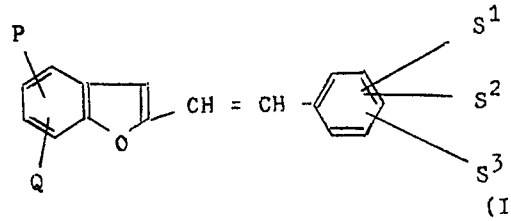

(II)

wherein P and Q stand for hydrogen or halogen atoms, lower alkyl or phenyl groups or together stand for a fused benzene nucleus or a lower alkylene group, $S^1$, $S^2$ and $S^3$ stand for hydrogen or halogen atoms, lower alkyl or phenyl groups, carboxy or sulfo groups of optionally modified functions, acyl, acylamino, sulfone, lower alkoxy, lower dialkylamino or lower trialkylammonium groups, in which case the groups mentioned for P, Q, $S^1$, $S^2$ and $S^3$ may be substituted by non chromophorous radicals. Compounds of the formula (II) are especially preferred in which two of the radicals $S^1$, $S^2$ and $S^3$ stand for hydrogen atoms and the third one stands for an electron attracting radical which is in ortho or, preferably, para position of the phenyl moiety of the styryl group. The electron attracting radical is, in this case, especially the phenyl or a carboxy group of optionally modified function, especially a cyano group or a lower carbalkoxy group.

The following benzofurane derivatives proved to be especially stable against perborate activators in detergent compositions:

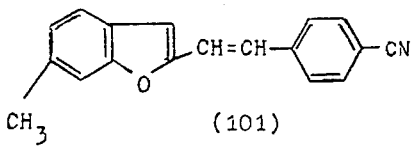

(101)

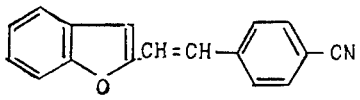

(102)

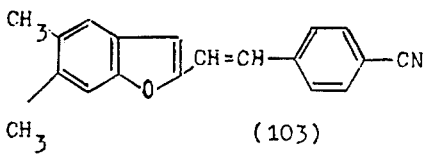

(103)

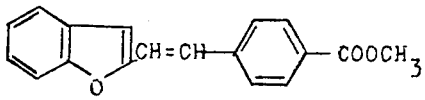

(104)

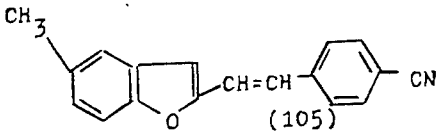

(105)

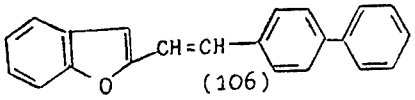

(106)

The present invention furthermore provides detergents for textiles which contain the activators and brighteners in accordance with the invention.

For this purpose, suitable textiles are, in addition to the materials generally to be treated at elevated temperatures ranging from about 70° to 100°C made of cotton or linen above all those which are made of or contain synthetic fibers, such as, for example, polyamide, polyester or polyacrylonitrile fibers and which are washed or bleached generally at low temperatures up to about 70°C, preferably at 30° to 60°C. Those textiles to be treated at low temperatures are also "easy care" materials of cellulose fibers or blends of synthetic fibers and cellulose fibers. The activators for inorganic peroxo compounds to be used according to the invention have the special advantage that already at the low temperatures at which these textiles are bleached and washed a sufficient activation of the peroxo compounds and a good bleaching effect are obtained.

For the use in bleaching and washing agents for textiles together with activators of the invention there are especially considered the inorganic peroxo compounds, especially the perborates having a neutral to alkaline reaction in aqueous solution. Among the various perborates the sodium perboratetetrahydrate is especially important. However, other perborates or peroxihydrates, for example, the peroxihydrates of the sodium ortho-, -pyro or -polyphosphates and the perhydrates of alkali metal carbonates may also be used.

The activators of the invention may easily be mixed, as powders or granules, with the other constituents of the detergents. When preparing, as it is usual, a detergent powder which does not yet contain peroxo compounds, by spray drying, that powder is then mixed with the inorganic peroxo compounds and the activator, in which case the powder preferably has a temperature of less than 30°C when adding the activation agent.

The activators to be incorporated into the detergents may also be coated with a suitable envelopping substance which is soluble in the washing liquor or can at least be swollen therein. Such suitable substances for envelopping the activators are, for example, water-soluble polyglycol ethers, polyvinyl alcohol, carboxymethyl cellulose, methyl, ethyl or oxethyl cellulose or also stearic acid.

The detergents which have been prepared using activators of the invention and inorganic peroxo compounds may, for the rest, have the constituents usual for these compositions. The mixture consisting of the activator and the inorganic peroxo compound may amount to about 10 to 100 % of the total composition. The portion of the optical brighteners is, in general, within the range of from about 0.1 to 1 % by weight. In the case of textile detergents, the portion of inorganic peroxo compound and activator is, generally, within the range of from about 10 to 50 % by weight. The other components of such detergents are, above all, surfactants in an amount of from 5 to 40, preferably 10 to 30 % by weight, builders in an amount of from about 10 to 80, preferably 30 to 75 % by weight and other detergent components and adjuvants, for example, anti-redeposition agents, enzymes, dyestuffs, perfumes and water in a total amount of from about 0 to 15, preferably 1 to 10 % by weight.

The surfactants may either be uniform products or mixtures on the basis of anionic or nonionic compounds. They may, for example, consist entirely or to a proportion of about 10 to 50 % by weight of soaps that may be derived from natural or synthetic fatty acids. They may further consist entirely of surface-active compounds of the sulfate or sulfonate type or may contain these compounds in an amount of about 30 to 70 %. Products of this type are, for example, long-chain alkyl-aryl sulfonates and aliphatic sulfonates, for example, long-chain alkane sulfonates, alkene sulfonates, oxyalkane sulfonates, furthermore, fatty alcohol sulfates and sulfation products of alkoxylated alkyl phenols, fatty acid amides or fatty acid alkylol amides containing about 1 to 20 ethoxy and/or propoxy radicals in the molecule, and sulfated monoglycerides. The anionic surfactants suitable for the use in detergents have been disclosed in detail, for example, in "Surface Active Agents and Detergents" by Schwartz, Perry and Berch, vol. II (1958), pages 25 to 102.

The surfactants of these detergents may either consist entirely of nonionic detergent basic materials or they may contain these materials in an amount of about 5 to 50 % by weight. In these products, the water-solubility of the hydrophobic molecule moiety generally containing about 8 to 25 carbon atoms, is brought about in the simplest case, by introducing polyether chains. Those nonionic detergent basic materials have been disclosed, for example, in "Surface Active Agents and Detergents," vol. II (1958), pages 120 to 143.

In addition to the nonionic and anionic detergent basic materials, the surfactant moiety of the detergents may also contain slighter amounts of up to about 8 % by weight of foam stabilizers or foam inhibitors.

The foaming power of the synthetic anionic or nonionic surfactants may also be reduced by adding soaps. So, certain combinations of synthetic anionic surfactants, nonionic surfactants and soap have their foaming power reduced substantially. The same applies, among others, also to the addition products of propylene oxide on surface-active polyethylene glycol ethers.

Another substantial component of the detergents are the so-called builders. At least part of them should give an alkaline reaction. For the rest, the builders may be inorganic or organic salts which give a weakly acid, neutral or alkaline reaction, especially salts having complexing properties. Useful builders are, for example, alkali metal carbonates or silicates, mono-, di- or trialkali metal orthophosphates, di- or tetraalkali metal pyrophosphates as well as the metaphosphates known as complexing agents; furthermore the water-soluble salts of high-molecular weight polycarboxylic acids, especially polymers of maleic acid, itaconic acid, mesaconic acid, fumaric acid, aconitic acid and methylenemalonic acid. Copolymers of these acids with one another or with other polymerizable substances, such as ethylene, propylene, acrylic acid, crotonic acid, vinyl acetate, acrylic amide and styrene, are also suitable. As complex-forming builders, the polyphosphates which give an alkaline reaction, especially tripolyphosphate, are particularly useful. Organic complexing agents to be used as builders are, for example, nitrilo-acetic acid, ethylene diamine tetraacetic acid and similar compounds. Suitable inorganic and organic builders have been disclosed, for example, in "Surface Active Agents and Detergents," vol. II (1958), pages 289 to 317.

To the mixture of inorganic peroxo compounds and activators in accordance with the invention there may optionally be added, furthermore, products having a stabilizing effect on the peroxo compounds which are known as "stabilizers for peroxo compounds." They may be insoluble or soluble in water and may be added to the peroxo compounds up to an amount of about 10 %, calculated on the weight of the peroxo compounds.

As stabilizers for peroxo compounds may be mentioned, above all, alkaline-earth metal silicates, especially magnesium silicates.

Water-soluble stabilizers which may take entirely or partially the place of the water-insoluble ones, are, above all, organic complexing agents.

Considering the disclosures made above the detergents have the following compositions (in % by weight):

69–96.9 % of detergent which consists itself of
5–40 % preferably 10 to 30 % of surfactant
10–80 % preferably 30 to 75 % of builders,
2–47 % of peroxo compound
0–10 % of stabilizer for peroxo compounds
0–15 % of anti-redeposition agents, enzymes, dyestuffs, perfumes and water;
0.1–1 % of brightener and
3–30 % of the compound of the formula I.

Depending on the intended purpose and on the application conditions, the pH-value of the aqueous liquors of the detergents may range from weakly acid over neutral to alkaline, as desired, and it may be adjusted by adding the corresponding inorganic or organic acids, buffer substances or bases. In the case of detergent liquors, the pH-value will be generally in the range of about 7 to 12, if the detergent is used in a 1 % solution. The pH-value of heavy-duty laundring agents is, in most cases, adjusted to a more alkaline value of about 9.5 to 12. The pH-value of detergents is generally adjusted by means of the builders which give a neutral to alkaline reaction.

The following Examples illustrate the invention, the parts and percentages being by weight, unless otherwise stated.

EXAMPLE 1 a. Unbrightened cotton fabric was washed 10 times for 20 minutes each at a temperature of 50°C, with a weight ratio of textile material to washing liquor of 1 : 40 and a detergent concentration of 5 g/l. The detergent had the following composition:

8.0 % of sodium dodecylbenzene sulfonate
3.0 % of tallow fat soap
3.0 % of tallow fat alcohol polyglycol ether (containing 11 ethylene oxide units on an average)
40.0 % of sodium tripolyphosphate
15.0 % of sodium perborate
5.0 % of sodium metasilicate
3.0 % of magnesium silicate
1.5 % of carboxymethyl cellulose (viscosity of the 2 % aqueous solution at 20°C according to Höppler = 1500 cP)
0.3 % of optical brightener (108)
15.0 % of hexaacetyltriethylene tetramine rest to 100.0 % sodium sulfate

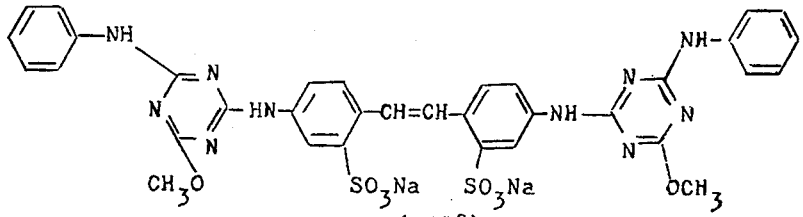

( 108)

b. In a parallel test an analogous detergent was used which contained instead of hexaacetyltriethylene tetramine tetraacetylglycol uril.

c. In a further control test an analogous detergent was used as in test (a), however, without containing a perborate activator.

The cotton stripes washed according to tests (a), (b) and (c) were rinsed and centrifuged.

The washing effect was established by measuring the degree of whiteness of the textile samples in the ELREPHO-whiteness degree measuring instrument using the X, Y, Z-filter and calculated according to the formula of A. Berger (cf. Die Farbe 8, pages 187 to 202, 1959)

$$W = Y + 3\,(Z - X)$$

The test values X, Y, Z measured were obtained by the remission values $R_x$, $R_y$ and $R_z$ measured by means of the conversion factors $X = 0.785\ Rx - 0.167\ Rz$
$Y = Ry$
$Z = 1.008\ Rz.$ The compatibility of the activators with the optical brighteners was established by measuring the brightening effect after 10 washing operations or the decrease of the whiteness degree of the textile stripes washed with detergent containing activator (test a and b) in comparison with the textile samples (test c) washed with detergents without an activator.

The results are summarized in the following Table:

TABLE 1

| Test | Degree of whiteness | Activator+ | Decrease of whiteness degree in % after 10 washing operations |
|---|---|---|---|
| a | 151,3 | H | 1,8 |
| b | 135,1 | T | 12,3 |
| c | 154,0 | | |

+H = hexaacetyltriethylene tetramine,
T = tetraacetylglycol uril.
These abbreviations are also used in the following examples.

EXAMPLE 2 a. A polyester fabric was washed ten times for 20 minutes each at a temperature of 50°C with a weight ratio of textile material to washing liquor of 1 : 40 and a detergent concentration of 5 g/l. The detergent had the following composition:

15 % of sodium perborate
5 % of polyglycol ether of technical-grade $C_{12} - C_{15}$ - alcohol and 9 mols of ethylene oxide
5 % of polyglycol ether of technical-grade $C_{12} - C_{15}$ - alcohol and 5 mols of ethylene oxide
45 % of sodium tripolyphosphate
9 % of sodium metasilicate
15 % of hexaacetyltriethylene tetramine
0.3 % of optical brightener (102)
3 % of caroboxymethyl cellulose (as in example 1) rest to 100.0 % sodium sulfate.

b. In a parallel test an analogous detergent was used which contained instead of hexaacetyltriethylene tetramine tetraacetylglycol uril.

c. In a control test an analogous detergent was used which did not contain a perborate activator.

The results of these washing tests were evaluated according to example 1 and summarized in the following table 2:

TABLE 2

| Test | Degree of whiteness after 10 washings | Activator | Decrease of whiteness degree in % after 10 washings |
|---|---|---|---|
| a | 108.0 | H | 0 |
| b | 103.4 | T | 4.3 |
| c | 108.0 | — | |

The same results with regard to the decrease of the whiteness degree were obtained when using instead of 0.3 % of compound 102 0.1 or 0.05 % of this compound.

When using the brighteners indicated in the following table 3 the results shown therein were obtained under the same conditions as those described in example 2.

TABLE 3

| Brightener | Activator | Degree of whiteness after 10 washings | Change of the degree of whiteness in % |
|---|---|---|---|
| — | — | 68.2 | — |
| 101 | — | 95.5 | — |
| 101 | T | 93.5 | − 2.1 |
| 101 | H | 99.6 | + 4.3 |
| 106 | — | 82.7 | — |
| 106 | T | 80.3 | − 2.9 |
| 106 | H | 84.3 | + 1.9 |

The observations made in the case of the polyester washing also apply to other fibrous materials that can be brightened by the substances belonging to the class mentioned above, for example, polyamide, cellulose acetate, polyacrylonitrile and others.

EXAMPLE 3

Cotton/polyester fabric (35/65 %) which had not been brightened was washed 10 times for 20 minutes each at a temperature of 50°C and with a weight ratio of textile material to washing liquor of 1 : 40 and a concentration of detergent of 5 g/l. The detergent had the following composition:

8.0 % of sodium dodecylbenzene sulfonate
3.0 % of tallow fat soap
3.0 % of tallow fat alcohol-polyglycol ether (having 11 ethyleneoxide units on an average)
40.0 % of sodium tripolyphosphate
15.0 % of sodium perborate
5.0 % of sodium silicate
3.0 % of magnesium silicate
15.0 % of activator
0.1 % of optical brightener
1.5 % of carboxymethyl cellulose (as mentioned in example 1) rest to
100 % sodium sulfate The detergents used in the control examples contained instead of the activator and/or the brightener a correspondingly larger amount of sodium sulfate. The results are shown in the following table 4.

TABLE 4

| Brightener | Activator | Degree of whiteness after 10 washings | change of whiteness degree in % |
|---|---|---|---|
| — | — | 154.6 | — |
| 101 | — | 157.7 | — |
| 101 | T | 141.8 | −10.1 |
| 101 | H | 155.8 | − 1.2 |
| 103 | — | 155.4 | — |
| 103 | T | 147.9 | − 4.8 |
| 103 | H | 155.8 | + 0.3 |
| 104 | — | 153.8 | — |
| 104 | T | 141.7 | − 7.9 |
| 104 | H | 157.2 | + 2.2 |
| 107 | — | 156.5 | — |
| 107 | T | 138.5 | −11.5 |
| 107 | H | 154.5 | − 1.3 |

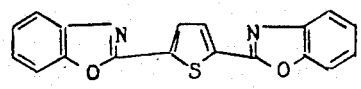

(107)

What is claimed is:

1. A composition of matter consisting essentially of
a. 69 to 96.9% by weight of a detergent,
b. 0.1 to 1% by weight of an optical brightener and c. 3 to 30% by weight of a compound of the formula

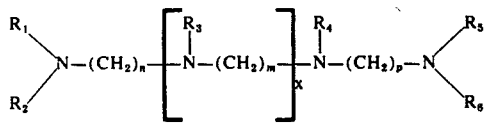

(I)

in which $R_1$ to $R_6$ are alkanoyl of 2 to 8 carbon atoms or benzoyl, $x$ is an integer of zero to 3 and $n$, $m$ and $p$ are 2 or 3.

2. A composition as defined in claim 1, wherein the brightener is of the bis-(triazinylamino)-stilbene disulfonic acid, benzoxazole, 1,4-diaryl-butadiene-(1,3) or 2-styryl benzofurane series.

3. A composition as defined in claim 1, wherein the brightener is a bis-(triazinlyamino)-stilbene disulfonic acid compound the triazine nuclei of which are substituted by lower alkoxy, lower mono- or dialkylamino, anilino or sulfoanilino.

4. A composition as defined in claim 1, wherein the brightener is 2,5-bis-(benzoxazolyl-2')-thiophene.

5. A composition as defined in claim 1, wherein the brightener is 1-(1'naphthyl)-4-(2'naphthyl)-butadiene-(1,3).

6. A composition as defined in claim 1, wherein the brightener has the formula

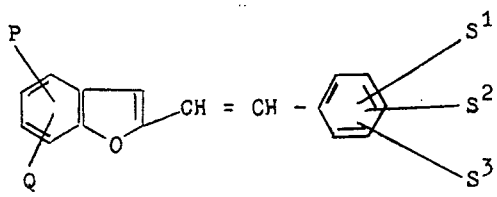

(II)

in which P and Q are hydrogen, halogen, lower alkyl or phenyl or P and Q together are lower alkylene or an annellated benzene ring, $S^1$, $S^2$ and $S^3$ are hydrogen, halogen, lower alkyl, phenyl, carboxy, sulfo, cyano, lower carboalkoxy, lower alkanoyl, lower alkanoylamino, lower alkylsulfonyl, lower alkoxy, lower dialkylamino or lower trialkylammonium.

7. A composition as defined in claim 1, wherein the brightener has the formula

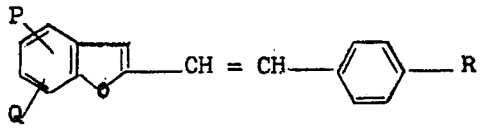

in which P and Q are hydrogen or methyl and R is cyano, lower carboalkoxy, carboxy or phenyl.

8. A composition as defined in claim 1, wherein the brightener is 2-(p-lower carboalkoxystyryl)-5,6-dimethyl-benzoxazole.

9. A composition as defined in claim 1, wherein in formula I $R_1$ to $R_6$ are acetyl or propionyl.

10. A composition as defined in claim 1, wherein in formula I $x$ is zero.

11. A composition as defined in claim 1, wherein in formula I $x$ is zero and $n$ and $p$ are 2.

12. A composition as defined in claim 1, wherein the compound of formula I is hexaacetyl triethylene tetramine.

13. A composition of matter consisting essentially of an optical brightener and a compound of formula I as defined in claim 1.

14. A composition of matter consisting essentially of a detergent and a compound of formula I as defined in claim 1.

15. A composition of matter consisting essentially of an inorganic peroxo compound and a compound of formula I as defined in claim 1.

16. A process for activating an inorganic peroxo compound in a detergent solution to set free the oxygen of the peroxo compound at a temperature below 80°C which comprises contacting said peroxo compound with a compound of formula I as defined in claim 1.

* * * * *